United States Patent [19]

Parker et al.

[11] 4,406,922

[45] Sep. 27, 1983

[54] STEREO BROADCAST SYSTEM

[75] Inventors: Norman W. Parker, Wheaton; Francis H. Hilbert, Addison, both of Ill.

[73] Assignee: Motorola Inc., Schaumburg, Ill.

[21] Appl. No.: 295,185

[22] Filed: Aug. 21, 1981

Related U.S. Application Data

[63] Continuation of Ser. No. 151,236, May 19, 1980.

[51] Int. Cl.[3] ..... H04H 5/00

[52] U.S. Cl. ..... 179/1 GS; 329/50

[58] Field of Search ..... 179/1 GS; 329/50; 455/61, 91

[56] References Cited

U.S. PATENT DOCUMENTS

| | | | |
|---|---|---|---|
| 3,067,293 | 12/1962 | Moore | 179/1 GS |
| 3,102,167 | 8/1963 | Barton | 179/1 GS |
| 3,217,105 | 11/1965 | Barton | 179/1 GS |
| 3,231,672 | 1/1966 | Collins, Jr. et al. | 179/1 GS |
| 3,732,375 | 5/1973 | Huribayashi | 179/1 GS |
| 4,218,586 | 8/1980 | Parker | 179/1 GS |
| 4,236,042 | 11/1980 | Leitch | 179/1 GS |

*Primary Examiner*—Robert L. Griffin
*Assistant Examiner*—Edward L. Coles
*Attorney, Agent, or Firm*—Margaret M. Parker; James S. Pristelski; James W. Gillman

[57] ABSTRACT

The signal transmitted is a compatible amplitude modulated carrier with amplitude directly proportional to the monaural information or 1+L+R up to a frequency near the upper end of the normal program spectrum. Above the transition region, the amplitude becomes a pure quadrature function. The instantaneous phase varies as a function of the quadrature phase relationship. Transmitter and receiver embodiments are disclosed.

14 Claims, 8 Drawing Figures

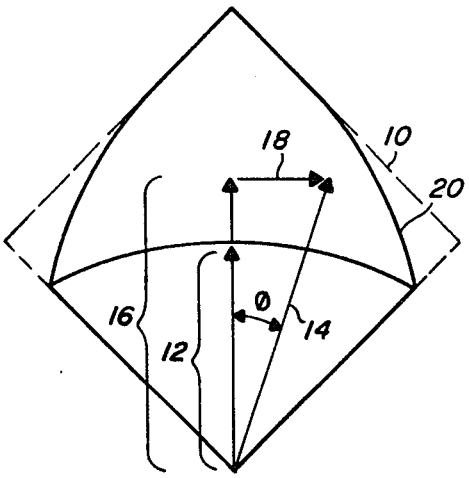
Fig. 1
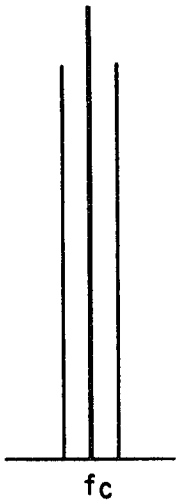
Fig. 2
Fig. 3
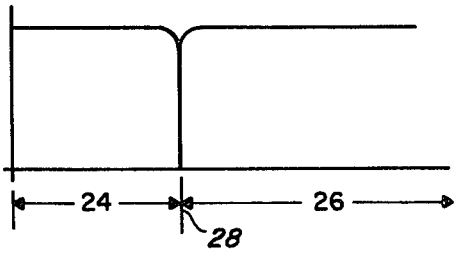
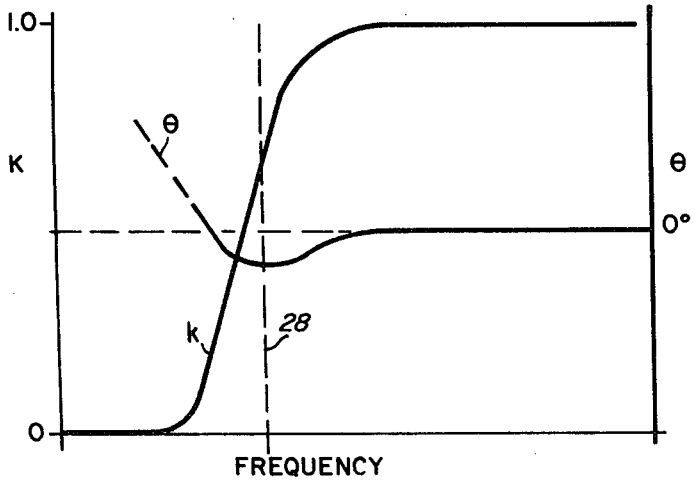
Fig. 6

STEREO BROADCAST SYSTEM

BACKGROUND OF THE INVENTION

This invention relates to the field of amplitude modulated stereo broadcasting and, more particularly, to a signal providing for minimal envelope distortion with minimal adjacent channel interference.

The simplest known signal for providing AM stereo broadcasting is probably the well known pure quadrature signal. Since the amplitude of a pure quadrature signal is the square root of the sum of the squares of the sum and difference signals, rather than the sum signal as in AM monophonic broadcasting, the quadrature signal is not compatible; i.e., a pure quadrature signal would produce a severely distorted audio output in a monophonic envelope detector.

A system providing no distortion in monophonic receivers was disclosed in a U.S. Pat. No. 4,218,586, assigned to the same assignee as is the present invention, in which the amplitude is always 1+L+R, and the instantaneous phase angle $\phi$ is the cosine of arc tan [(L−R)/(1+L+R)]. While this signal is ideal for all normal program material, under extreme program conditions such as a high frequency signal in one channel only with a high modulation level, a slight increase in the amount of adjacent channel interference is possible. The only known systems with no spurious adjacent channel interference-producing sidebands are quadrature systems, and attempts have been made to provide a practical quadrature signal by reducing the level of the difference signal. Various percentages of reduction have been tested, but any slight improvement in distortion in monophonic receivers has been outweighed by the loss in signal-to-noise ratio in the stereophonic receivers due to the necessity of increased gain to compensate for the reduced difference signal.

SUMMARY OF THE INVENTION

It is an object of the present invention to provide a signal for AM stereophonic broadcasting which will combine minimal adjacent channel interference with minimal envelope distortion in both mono and stereophonic receivers.

This object and others are provided in a system wherein the transmitted signal is a distortion-free signal for all frequencies occurring in normal program material, and changes to a signal having some envelope distortion at higher frequencies, but which prevents adjacent channel interference in the event of a strong high frequency tone in one channel only. The amount of envelope distortion generated is in direct proportion to the magnitude of the higher order sidebands suppressed by the use of quadrature modulation. The effective distortion is negligible for nearly all realizable program material. The signal is of the form $e_c = \sqrt{(1+L+R)^2+[k(L-R)\angle\theta]^2}\cos(\omega_c t+\phi)$ where $\phi = \text{arc tan}\,[(L-R)/(1+L+R)]$ and k and $\theta$ are functions of audio frequency. In a transmitter, the sum and difference signals would be coupled to a quadrature modulator, the modulated signal would be limited to remove the amplitude variations and the resulting carrier signal, modulated in phase only, would be coupled to the transmitter. The difference signal would be coupled to a high-pass filter and the filtered signal and the sum signal would be coupled to a second quadrature modulator. The envelope of the second modulated signal would also be coupled to the high level modulator.

In a receiver, a process which is effectively the inverse of the transmitter process provides essentially the original left and right program signals. In a preferred embodiment, the IF output would be coupled to an envelope detector, the output of which would be 1+L+R below a transition frequency and the quadrature modulation amplitude above the transition. The detector output is coupled to a comparator. The comparator output controls the gain of an amplifier which, by means of a feedback loop, is forced to provide an amount of gain sufficient to allow a pair of multiplier circuits, supplied with carrier signals in quadrature, to output the sum and difference signals which are then matrixed to produce the left and right program signals.

BRIEF DESCRIPTION OF THE DRAWING

FIG. 1 is a phasor diagram illustrating the transmitted signal of the invention.

FIG. 2 is a frequency chart for a pure quadrature AM signal.

FIG. 3 is a frequency spectrum of the signal of the system.

FIG. 6 is a frequency chart relating to the transmitted signal.

DETAILED DESCRIPTION OF THE PREFERRED EMBODIMENTS

Figure 4:
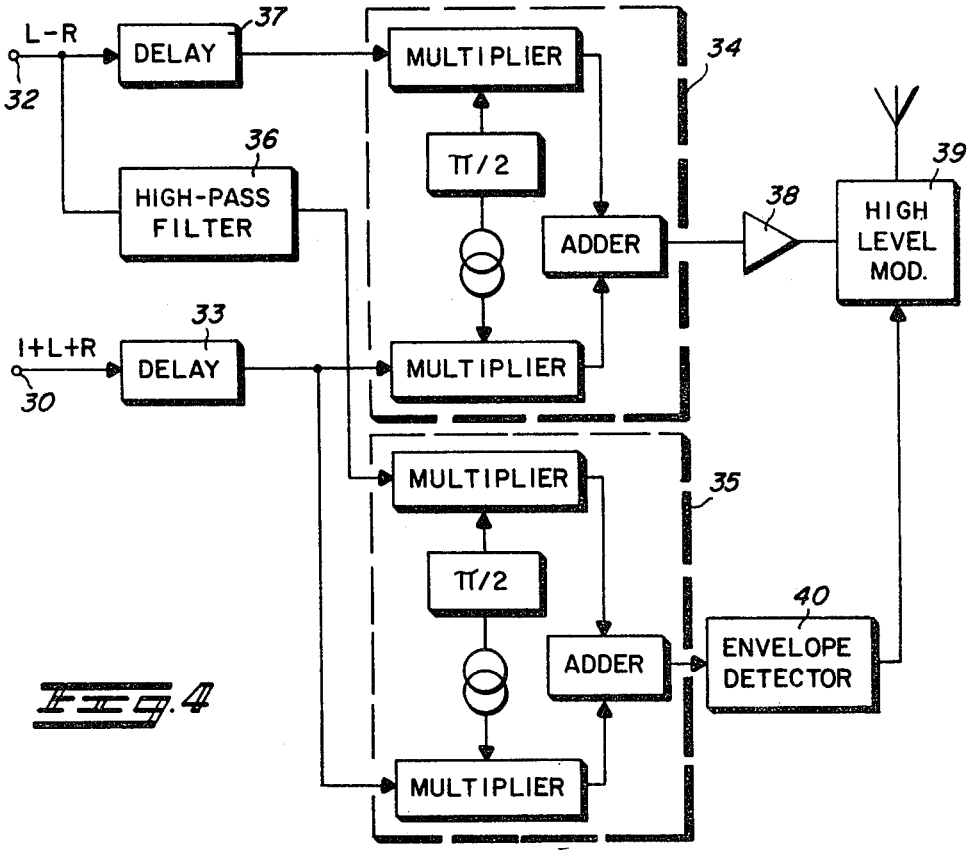
FIG. 4 is a block diagram of a transmitter embodiment.

The system of the present invention is identical to the system of the above-referenced copending application for frequencies in the program material below a predetermined frequency. This frequency, which will be termed the "transition" frequency, was chosen to be near the upper end of the range of normal program material. In the preferred embodiments, this frequency is in the order of 3,000 Hz, (approximately the highest key on the piano). Above this frequency, there are generally only harmonics, with considerably lower energy levels. Above the transition frequency, the system becomes a pure quadrature system.

In the diagram of FIG. 1, the dashed line 10 is a square which represents the locus of the modulated signal for a pure quadrature system. The unmodulated carrier is represented by a phasor 12. The modulated carrier is represented by a phasor 14, the resultant of a sum signal 16 (1+L+R) and a difference signal 18 (L−R) at an angle $\phi$ where $\phi$ is arc tan [(L−R)/(1+L+R)]. The modified locus indicated by the solid line 20 corresponds to the locus 10, with each point multiplied by the cosine of $\phi$. In the present system, signals below the transition region will be within the locus 20, and those above will be within the locus 10.

FIG. 2 is a spectrum chart of a pure quadrature AM signal with a modulating signal at a single frequency, and showing only one pair of sidebands. This lack of higher order sidebands is the advantage of the unmodified quadrature signal and, if it were not for the requirement for compatibility, pure quadrature would be the ideal way to amplitude modulate the carrier. Since compatibility is required, the modified quadrature signal is preferred over most of the program spectrum. Pure quadrature is thus preferred only at the higher frequencies where a strong left- or right-only signal could possibly produce out-of-channel sidebands, though at a low power level.

FIG. 3 is a frequency chart for the signal of the system showing an area 24 where the signal is modified (compatible) quadrature, an area 26 where the signal is pure quadrature, and the transition frequency 28. It will be appreciated that the transition frequency 28 is actually a narrow region in which the broadcast signal changes from modified to pure quadrature. The preferred transition frequency is at present at approximately 3,000 Hz, but no such limitation is to be attributed to the system.

FIG. 4 is a preferred embodiment of a transmitter for the system. The signal coupled into a terminal 30 is given as $1+L+R$ and the signal at terminal 32 is $L-R$, but these are exemplary only, and could represent any two signals which are to be transmitted on a single carrier. The signal from the terminal 30 is coupled through a delay element 33 to two quadrature modulators 34, 35. The signal from the terminal 32 is coupled to the modulator 35 through a high-pass filter 36 and, through a delay element 37, to the modulator 34. The output signal of the modulator 34 will thus be a pure quadrature signal. This signal is coupled through a limiter 38, whose output is a carrier frequency modulated in phase only, to a transmitter 39, which may be represented as a high level modulator. The output signal of the modulator 35 will be a modified quadrature signal for audio frequencies below the transition frequencies and a pure quadrature signal for frequencies above the transition. The output of the modulator 35 is coupled to an envelope detector 40, and the amplitude modulation is coupled to the high level modulator 39. The two carrier frequency sources of the modulators 34, 35 need not be of the same frequency.

Figure 5:
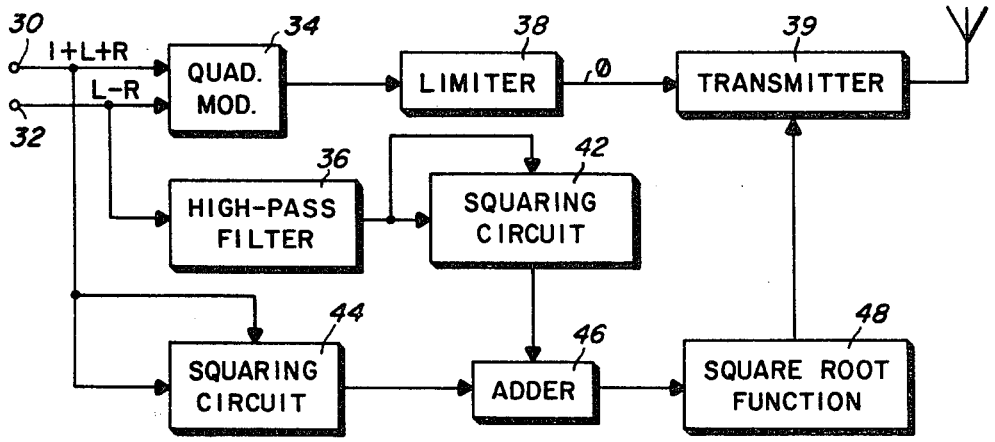
FIG. 5 is a block diagram of a second embodiment of the transmitter.

In the transmitter embodiment of FIG. 5, the signals from terminals 30, 32 are coupled to the quadrature modulator 34 which could as in FIG. 4 consist of a carrier frequency source with two outputs, a 90° phase shifter coupled to one output, an amplitude modulator coupled to modulate the carrier signal with $1+L+R$ and another amplitude modulator coupled to modulate the phase shifted carrier with $L-R$, the two carriers then being combined. The output of the modulator 34 is coupled to a limiter 38 where the amplitude variations are removed and the phase modulated carrier is then coupled to the high level modulator input of an AM transmitter 39. The $L-R$ signal is coupled through the high-pass filter 36 which removes frequencies below the transition frequency 28, and the filter output is squared in a squaring circuit 42. The sum or monophonic signal is coupled from the terminal 30 to a second squaring circuit 44 and the output of circuit 44 is coupled to an adder 46 where it is combined with the output of circuit 42. The adder 46 output is then $(1+L+R)^2+[k(L-R)\angle\theta]^2$ where k is a function of frequency; in general, $k=0$ at frequencies below the transition frequency 28 and $k=1$ above the transition frequency with, naturally, a transition region. The output signal of the adder 46 is coupled to a square root circuit 48 and the output of circuit 48 is coupled to the transmitter 38 where the high level modulation occurs. Delay lines have been omitted in this drawing figure for simplicity.

FIG. 6 is a chart of k and $\theta$ versus audio frequency and shows the variation of k from zero below transition 28 to a value of one above the transition. When $k=0$, the output of the detector 36 of FIG. 4 or the circuit 48 of FIG. 5 would be $1+L+R$. $\theta$ represents the differential phase error of the filter 36 output as compared to the output of the delay 33. Due to the inherent characteristics of the high-pass filter 36, a slight phase shift may occur as the frequency approaches the transition frequency 28. Below the transition frequency, there is a larger theoretical phase shift, but this occurs when the signal has been completely attenuated and is of no significance.

Figure 7:
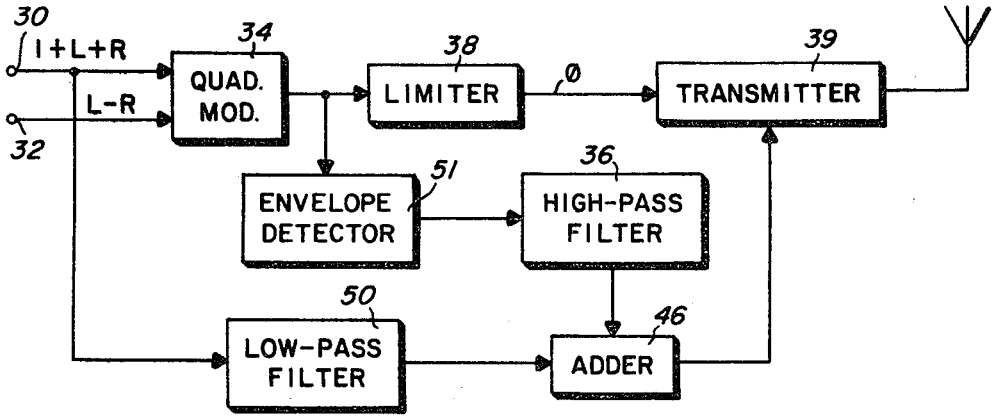
FIG. 7 is a block diagram of yet another embodiment of the transmitter.

FIG. 7 is a third embodiment of a transmitter for the system with, as before, $1+L+R$ coupled to the terminal 30 and $L-R$ coupled to the terminal 32. The quadrature modulator 34 and limiter 38 function as in the transmitter of FIG. 4. The $1+L+R$ signal is coupled to a low-pass filter 50, with cut-off at the transition frequency 28, and the filter output is coupled to the adder 46. The output of the quadrature modulator is coupled through an envelope detector 51 to the high-pass filter 36, and the filtered output is coupled to the adder 46. Since the adder 46 output is $1+L+R$ below the transition frequency, and is $\sqrt{(1+L+R)^2+(L-R)^2}$ above the transition frequency, the adder output is coupled directly to the transmitter 38. Delay lines have been omitted in this drawing also.

Figure 8:
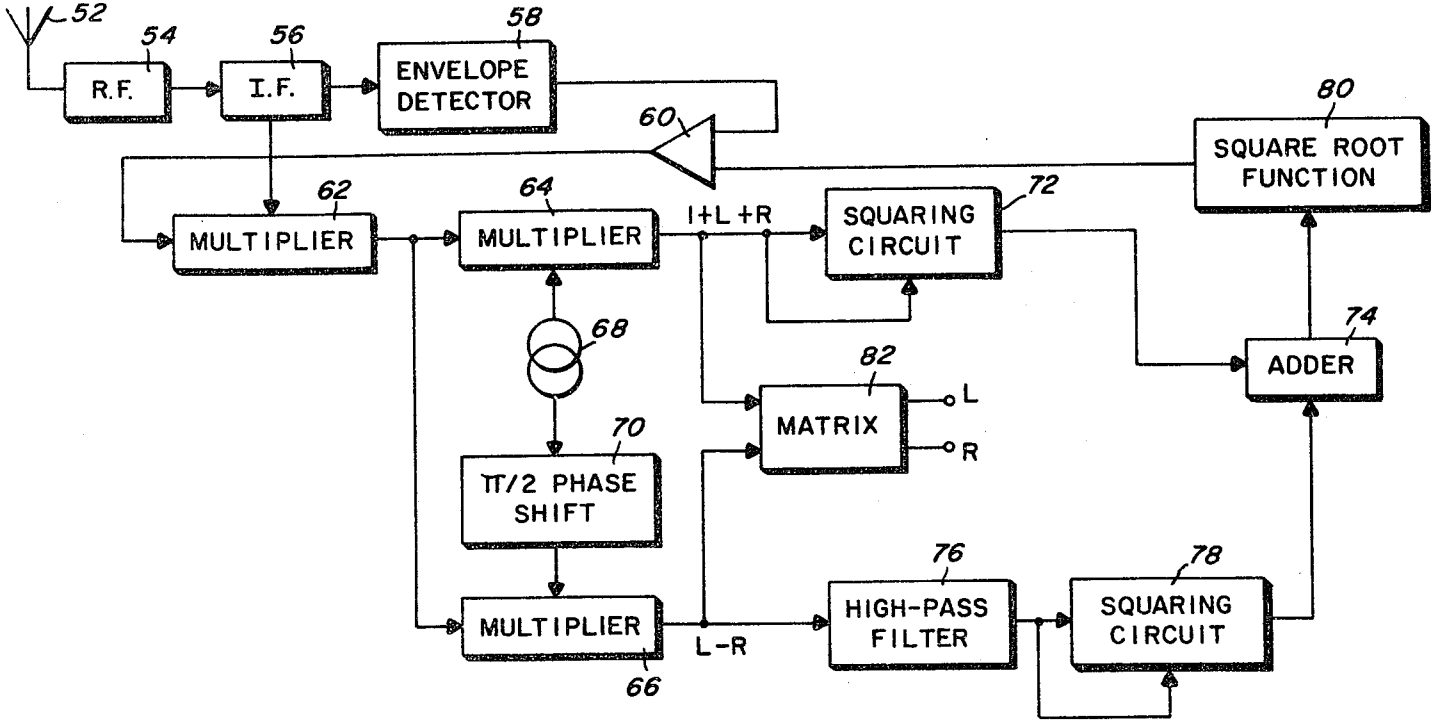
FIG. 8 is a block diagram of a preferred embodiment of a receiver for the system.

FIG. 8 shows a preferred embodiment of a receiver for receiving the broadcast signal from any of the transmitters of FIGS. 4, 5 and 7 and providing the original L and R signals. The broadcast signal is received at an antenna 52, processed as is customary in an RF stage 54 and IF stage 56, then coupled to an envelope detector 58. The amplitude modulation signal is then coupled to a comparator 60. The output of the comparator is coupled to control the gain of a multiplier 62 having the output of the IF stage 56 as an input signal. The gain controlled output of the multiplier 62 is coupled to multipliers 64 and 66, the outputs of which are forced to be $1+L+R$ and $L-R$ respectively. These quadrature components are derived by means of two carrier frequency signals in quadrature supplied by a signal source 68 and a 90° phase shifter 70. The output of the multiplier 64 is coupled through a squaring circuit 72 to an adder 74. The output of the multiplier 66 is coupled through a high-pass filter 76 and a squaring circuit 78 to the adder 74. The output of the adder is coupled to a square root circuit 80 and the resulting signal is coupled to control the comparator 60 output. The output of the multiplier 64 is thus forced to be the sum or monophonic signal $(1+L+R)$ and the output of the multiplier 66 is then the true difference signal $(L-R)$. Both of the sum and difference signals are coupled to a matrix 82, the outputs of which are L and R.

Thus there has been shown and described a system for providing a compatible AM stereophonic signal which changes from modified quadrature to pure quadrature at a transition point near the upper limit of normal program material. Other variations and modifications are possible and it is intended to cover all such as fall within the spirit and scope of the appended claims.

What is claimed is:

1. A compatible AM stereophonic system for transmitting and receiving signals wherein the signal transmitted is a compatible quadrature signal below a transition frequency and a quadrature signal above the transition frequency and wherein the transmitter comprises:

first and second input means for receiving sum and difference signals respectively;

first modulating means coupled to the input means for providing a first pair of quadrature signals amplitude modulated with the sum and difference signals respectively and combining said signals;

limiter means coupled to the modulating means for removing the amplitude variation from the modulated signal, leaving a phase modulated signal;

means coupled to the input means for providing a modulating audio signal which is the envelope of a substantially pure quadrature signal above a predetermined frequency and is 1+L+R below the predetermined frequency;

second modulating means coupled to the audio signal providing means and the limiter means for amplitude modulation of the phase modulated signal by the modulating audio signal;

and receiver means comprising:

input means for receiving the output signal of the transmitter;

demodulating means for providing a first output signal substantially equal to 1+L+R and a second output signal substantially equal to L−R; and matrixing means coupled to the demodulating means for providing output signals substantially equal to L and R.

2. A compatible AM stereophonic system in accordance with claim 1 wherein the means for providing a modulating audio signal includes a high-pass filter coupled to the second input means, third modulating means for providing a second pair of quadrature signals, and envelope detector means coupled to the output of the third modulating means.

3. A compatible AM stereophonic system in accordance with claim 1 and wherein the transmitter means for providing a modulating signal comprises envelope detector means coupled to the first modulating means, high-pass filter means coupled to the limiter means, low-pass filter means coupled to the first input means, and adder means coupled to the high-pass and low-pass filter means.

4. A compatible AM stereophonic system in accordance with claim 1 wherein the transmitter means for providing a modulating audio signal comprises high-pass filter means coupled to the second input means, first squaring means coupled to the filter means output, second squaring means coupled to the first input means, adder means coupled to the first and second squaring means, square root means coupled to the output of the adder means and to the input of the second modulating means.

5. A compatible AM stereophonic system in accordance with claim 1 wherein the demodulating means of the receiver comprises quadrature detector means and means coupled to the detector means for converting the signal from the input means to a pure quadrature signal.

6. A compatible AM stereophonic system in accordance with claim 1 wherein the demodulating means of the receiver comprises envelope detector means coupled to the input means, comparator means coupled to the output of the envelope detector means, first multiplier means coupled to the outputs of the input means and the comparator means, means for providing carrier signals in quadrature, second multiplier means coupled to the first multiplier means and to one output of the quadrature signal means, third multiplier means coupled to the first multiplier means and to a phase shifted output of the quadrature signal means, first squaring means coupled to an output of the second multiplier means, high-pass filter means coupled to the output of the third multiplier means, second squaring means coupled to an output of the filter means, adder means coupled to the outputs of the first and second squaring means, square root means coupled to an output of the adder means and to a second input of the comparator means, and matrix means coupled to the outputs of the second and third multiplier means.

7. A compatible AM stereophonic system in accordance with claim 1 wherein the signal is $e_c = \sqrt{(1+L+R)^2+\}k(L-R)\angle\theta\}^2} \cos(\omega_c t+\phi)$ where L and R are program signals, k and $\theta$ are functions of the audio frequency and $\phi$ is arc tan $\{(L-R)/(1+L+R)\}$.

8. A compatible AM stereophonic transmitter for providing signals of the form $e_c = \sqrt{(1+L+R)^2+\{k(L-R)\angle\theta\}^2} \cos(\omega_c t+\phi)$ where L and R are program signals, k and $\theta$ are functions of the audio frequency and $\phi$ is arc tan $\}(L-R)/(1+L+R)\}$ wherein the transmitter comprises:

first and second input means for receiving sum and difference signals respectively;

means for providing quadrature signals;

means coupled to the input means for modulating the respective quadrature signals with the sum and difference signals;

adder means for combining the modulated quadrature signals;

limiter means coupled to the modulating means for removing the amplitude variation from the modulated signal, leaving a phase modulated signal;

means coupled to the input means for providing a modulating audio signal and including high-pass filter means coupled to the second input means, a carrier frequency source having two outputs, a phase shifting means coupled to one carrier frequency source output for shifting the respective output signal by 90°, third modulator means coupled to the second input means and to the phase shifting means, fourth modulator means coupled to the first input means and to the carrier frequency source, adder means coupled to the second and third modulator means, and envelope detector means coupled to the adder means; and second modulating means coupled to the audio signal providing means and the limiter means for high level modulation of the phase modulated signal by the modulating audio signal.

9. A compatible AM stereophonic transmitter for providing signals of the form $e_c = \sqrt{(1+L+R)^2+\{k(L-R)\angle\theta\}^2} \cos(\omega_c t+\phi)$ where L and R are program signals, k and $\theta$ are functions of the audio frequency and $\phi$ is arc tan $\{(L-R)/(1+L+R)\}$ wherein the transmitter comprises:

first and second input means for receiving sum and difference signals respectively;

means for providing quadrature signals;

means coupled to the input means for modulating the respective quadrature signals with the sum and difference signals;

adder means for combining the modulated quadrature signals;

limiter means coupled to the modulating means for removing the amplitude variation from the modulated signal, leaving a phase modulated signal;

means coupled to the input means for providing a modulating audio signal and including high-pass filter means coupled to the difference signal input means, second means for providing quadrature signals, second modulator means coupled to the second quadrature signal means for receiving the first output signal and to the filter means for providing a carrier signal modulated with the filter output signal, third modulator means coupled to the second quadrature signal means for receiving a second output signal and to the sum signal input means for providing a second carrier signal modulated with the sum signal, adder means coupled for combining the output signals of the second and third modulator means, and amplitude detector means coupled to the output of the adder means for detecting the amplitude of the combined signals and coupled to the input of the second modulator means; and second modulating means coupled to the audio signal providing means and the limiter means for high level modulation of the phase modulated signal by the modulating audio signal.

10. A compatible AM stereophonic system for transmitting and receiving signals of the form $e_c = \sqrt{(1+L+R)^2+\{k(L-R)\angle\theta\}^2}\cos(\omega_c t+\phi)$ where L and R are program signals, k and $\theta$ are functions of the audio frequency and $\phi$ is arc tan $\{(L-R)/(1+L+R)\}$ wherein the transmitter comprises:

first and second input means for receiving sum and difference signals respectively;

means for providing quadrature signals;

means coupled to the input means for modulating the respective quadrature signals with the sum and difference signals;

adder means for combining the modulated quadrature signals;

limiter means coupled to the modulating means for removing the amplitude variation from the modulated signal, leaving a phase modulated signal;

means coupled to the input means for providing a modulating audio signal and including high-pass filter means coupled to the second input means, first squaring means coupled to the filter means output, second squaring means coupled to the first input means, adder means coupled to the first and second squaring means, square root means coupled to the output of the adder means and to the input of the second modulating means; and second modulating means coupled to the audio signal providing means and the limiter means for high level modulation of the phase modulated signal by the modulating audio signal.

11. A compatible AM stereophonic receiver for receiving signals of the form $e_c = \sqrt{(1+L+R)^2+\{k(L-R)\angle\theta\}^2}\cos(\omega_c t+\phi)$ where L and R are program signals, k and $\theta$ are functions of the audio frequency and $\phi$ is arc tan $\{(L-R)/(1+L+R)\}$, and comprising:

input means for receiving the output signal of the transmitter;

demodulating means for providing a first output signal substantially equal to 1+L+R and a second output signal substantially equal to L−R; and including envelope detector means coupled to the input means, comparator means coupled to the output of the envelope detector means, first multiplier means coupled to the outputs of the input means and the comparator means, means for providing carrier signals in quadrature, second multiplier means coupled to the first multiplier means and to one output of the quadrature signal means, third multiplier meanws coupled to the first multiplier means and to a phase shifted output of the quadrature signal means, first squaring means coupled to an output of the second multiplier means, highpass filter means coupled to the output of the third multiplier means, second squaring means coupled to an output of the filter means, adder means coupled to the outputs of the first and second squaring means, square root means coupled to an output of the adder means and to a second input of the comparator means, and matrix means coupled to the outputs of the second and third multiplier means for providing output signals substantially equal to L and R.

12. A compatible AM stereophonic transmitter for providing signals of the form $e_c = \sqrt{(1+L+R)^2+\{k(L-R)\angle\theta\}^2}\cos(\omega_c t+\phi)$ where L and R are program signals, K and $\theta$ are functions of the audio frequency and $\phi$ is arc tan $\{(L-R)/(1+L+R)\}$ and wherein the transmitter comprises:

first and second input means for receiving first and second input signals corresponding to sum and difference signals respectively;

first circuit means responsive to said first and second input signals for providing a third signal which may be substantially a compatible quadrature signal; and filter means coupled to the first circuit means for filtering the second input signal for altering the third signal to provide an output signal which is a substantially compatible quadrature signal below a predetermined transition frequency and a substantially pure quadrature signal above said transition frequency.

13. A transmitter according to claim 12 and wherein the first circuit means includes second circuit means for providing an essentially pure quadrature signal, third circuit means for removing the amplitude modulation from the pure quadrature signal, and high level modulator means.

14. A transmitter according to claim 12 and wherein the first circuit means includes second circuit means coupled to the first input means for squaring the first input signal, third circuit means coupled to square the output signal of the filter means, combining means for combining the two squared signals, and fourth circuit means coupled to the output of the combining means for providing a signal which is substantially the square root of the output signal of the combining means.

* * * * *